US006266046B1

(12) United States Patent
Arita

(10) Patent No.: US 6,266,046 B1
(45) **Date of Patent: *Jul. 24, 2001**

(54) POINTING DEVICE FOR MOVING AND POSITIONING A POINTER ON A DISPLAY OF A COMPUTER

(75) Inventor: Takashi Arita, Tokyo (JP)

(73) Assignee: Fujitsu Takamisawa Component Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/864,963

(22) Filed: May 29, 1997

(30) Foreign Application Priority Data

May 29, 1996 (JP) ..... 8-134920

(51) Int. Cl.[7] ..... G09G 5/00
(52) U.S. Cl. ..... 345/156; 345/157; 345/161
(58) Field of Search ..... 345/156–159, 345/160, 161; 200/5 R, 6 R, 8 R

(56) References Cited

U.S. PATENT DOCUMENTS

| | | | | |
|---|---|---|---|---|
| 3,731,546 | | 5/1973 | MacDonald | 74/63 |
| 4,488,017 | * | 12/1984 | Lee | 200/5 R |
| 4,496,217 | | 1/1985 | Aoyagi | 350/255 |
| 4,748,323 | * | 5/1988 | Holiday | 250/221 |
| 4,977,298 | * | 12/1990 | Fujiyama | 200/5 |
| 5,043,709 | * | 8/1991 | Kim | 340/709 |
| 5,140,313 | * | 8/1992 | Wen | 340/709 |
| 5,252,821 | * | 10/1993 | Sugimura | 250/22 |
| 5,278,557 | * | 1/1994 | Stokes et al. | 341/34 |
| 5,473,325 | * | 12/1995 | McAlindon | 341/20 |
| 5,504,502 | | 4/1996 | Arita et al. | 345/160 |
| 5,555,004 | * | 9/1996 | Ono et al. | 345/161 |
| 5,675,359 | * | 10/1997 | Anderson | 345/161 |
| 5,706,027 | * | 1/1998 | Hilton et al. | 345/156 |
| 5,714,980 | * | 2/1998 | Niino | 345/160 |

FOREIGN PATENT DOCUMENTS

| | | |
|---|---|---|
| 41 11 140 | 11/1991 | (DE) . |
| 0 432 786 | 6/1991 | (EP) . |
| 2 145 502 | 3/1985 | (GB) . |

* cited by examiner

*Primary Examiner*—Almis R. Jankus
*Assistant Examiner*—Henry N. Tran
(74) *Attorney, Agent, or Firm*—Staas & Halsey LLP

(57) ABSTRACT

A pointing device for moving a display pointer by tilting a center shaft including a magnet and using Hall elements fixed near the magnet. The center shaft is sustained by a pivot sustainer fixed on a central axis of the device, and the tilting movement of the center shaft is changed to movement made along the central axis by a movement converting mechanism using spring force, for moving the magnet back on the central axis when the center shaft is freed from tilting.

15 Claims, 10 Drawing Sheets

POINTING DEVICE FOR MOVING AND POSITIONING A POINTER ON A DISPLAY OF A COMPUTER

BACKGROUND OF THE INVENTION

1. Field of the Invention

The present invention relates to a pointing device for moving a pointer or a cursor on a display of a computer to a desired position. In particular, the present invention relates to a pointing device which produces no positioning error of the pointer even though mechanical vibration or shock is added to the pointing device after determining a designated position of the pointer, so that the pointer is moved back to the designated position after the vibration or shock is over.

2. Description of the Related Art

Generally, data for operating a computer or carrying out application programs of the computer are processed by operating a keyboard of the computer. Recently, a pointing device such as a mouse or a digitizer comes into existence and its usefulness has been widely approved because of convenience of performing dialog operation between an operator and the computer.

The pointing device, which will be called a separated type pointing device hereinafter, such as the mouse or the digitizer is usually applied to a desk-type computer. However, when a portable computer such as a laptop type or a notebook type computer comes into existence, the separated type pointing device becomes inconvenient of use, because, it is hard to find a space for placing the separated type pointing device around the portable computer.

Then, a new type pointing device, which will be called an attached type pointing device hereinafter, such as a trackball type, a tilting lever (or joystick) type or a sliding head type pointing device has been developed for the portable computer.

The attached type pointing device is mechanically attached to the keyboard, and does not require a space for operating the attached type pointing device around the portable computer. The attached type pointing device is also applied to an amusement computer generally called "game machine". In case of the amusement computer, a terminal box is usually used for remotely controlling the amusement computer. The attached type pointing device is mounted on the terminal box so that the attached type pointing device can be easily handled by anyone from a child to a man in any posture, sitting on a sofa or lying on a floor. The attached type pointing device consists of a supporting member and a manually actuating movable member, which will be simply called "movable member" hereinafter, mounted on the supporting member. The supporting member is for supporting the movable member and fixing the attached type pointing device to the keyboard or the terminal box. The movable member is provided for moving the pointer on the display by touching the movable member with a finger of the operator. The movable member can be moved freely in a limited zone. When the movable member is freed from the operator's touch, the movable member returns to a center position of the limited zone and stays there, and when the movable member is moved, the pointer is moved on the display in the same direction as the movable member at a speed proportional to a distance of the movable member moved from the center position.

In either case of the portable computer or the amusement computer, when the movable member is freed from operator's touch after the pointer has been positioned to a designated position on the display, it is desired that the pointer is fixed to the designated position and not affected by vibration or shock added to the pointing device and/or a change of a supporting posture of the pointing device against gravity.

In short, the attached type pointing device has been required to have a high return accuracy, producing no pointing error when the vibration or shock is added to the pointing device and/or the supporting posture of the pointing device is changed.

Typical pointing devices of the prior art are shown in FIGS. 1, 2, 3A, 3B and 3C. FIG. 1 is a schematic side view of a joystick type pointing device (100) of the prior art, FIG. 2 is a schematic side view of a sliding head type pointing device (200) of the prior art, and FIGS. 3A, 3B and 3C illustrate typical returning mechanisms of the prior art, applied to the movable member of the sliding head type pointing device 200 shown in FIG. 2.

The joystick type pointing device 100 shown in FIG. 1 is a typical attached type pointing device of the prior art applied to the amusement computer. The joystick type pointing device 100 consists of a lever (marked LEVER in the figure) (11), a close-coiled helical spring (SPRING) (13) inserted between a root of the LEVER 11 and a frame (FRAME) (12) on which the LEVER 11 is mounted, and a pointer coordinate detecting part (DET PART) (14) consisting of a light emitter (LIGHT EMITTER) (15) provided at a bottom tip of the LEVER 11 and a light receiver (LIGHT REC) (16) arranged on a printed circuit board (PCB) (17) located beneath the FRAME 12 directly opposite to the LIGHT EMITTER 15. The LIGHT REC 16 consists of a plurality of light detecting elements arranged in a matrix. For example, a Charge-Coupled Device (CCD) is used for the LIGHT REC 16. When the LEVER 11 is leaned against the force of the SPRING 13, the shaft of the LEVER 11 inclines, so that a direction of light radiated from the LIGHT EMITTER 15 is changed. Then, the light radiated from the LIGHT EMITTER 15 comes into designated light detecting elements. As a result, the designated light detecting elements produce electrical signals having information on a direction and a moving speed of the pointer.

However, when the joystick type pointing device is applied to the terminal box, there have been problems as follows.

1) Because of that the joystick type pointing device cannot be made small in size, the size of the terminal box becomes large. As a result, the terminal box must be held by both hands, causing a problem that the terminal box is hard to be held by children.
2) When the LEVER 11 is freed from the operator's hand, a gravity center of the LEVER 11 is moved upward because of the characteristics of the SPRING 13. Therefore, there is a problem that when a supporting posture of the terminal equipment is changed, the LEVER 11 tends to incline due to terrestrial gravitation and vibrate due to a mechanical shock given to the terminal box.
3) When the LEVER 11 having inclined is freed from the operator's hold, the LEVER 11 is going to return to a center position by the force of the SPRING 13. However, because of the characteristics of the SPRING 13, the LEVER 11 does not completely return to the center position, particularly when the inclination of the LEVER 11 is little. This produces a problem of decreasing the returning accuracy of the pointer, so that the pointer does not stay at the designated position and drifts inch by inch.

In order to solve the above problems, a new attached type pointing device called "sliding head type pointing device" has been developed. Regarding the sliding head type pointing device, Japanese Patent Publication 7-117876 and U.S. Pat. No. 5,504,502 are given to the same inventor Takashi Arita and others in Dec. 18, 1995 and Apr. 2, 1996 respectably.

FIG. 2 is a cross-sectional side view of the sliding head type pointing device 200 of the prior art. The sliding head type pointing device 200 consists of a sliding head (SLIDING HEAD) (21) as the movable member and a housing (HOUSING) (22) as the supporting member.

The SLIDING HEAD 21 has a round domed configuration consisting of a domed rubber part (RUBBER) (23) and a domed slider (SLIDER) (24) provided on an inner surface of the RUBBER 23. At a center of the RUBBER 23, there is an inward depressed portion into which a finger tip is inserted for sliding the SLIDING HEAD 21 on the HOUSING 22. At the inward depressed portion, there is a magnet holding part (25) in which a permanent magnet (MAGNET) (26) is buried so as to be placed at the center of the SLIDING HEAD 21. The SLIDING HEAD 21 is set on the HOUSING 22 so that the MAGNET 26 is brought in a central axis of the HOUSING 22 when the SLIDING HEAD 21 is freed. The MAGNET 26 is used for producing information on a position and moving speed of the pointer on the display. In order to produce the information, other kinds of elements such as optical elements may be used. Therefore, an element such as the MAGNET 26 can be called "pointer positioning element" generally.

The HOUSING 22 has round domed structure for mounting the SLIDING HEAD 21 and fitting the sliding head type pointing device 200 to the terminal box not depicted in FIG. 2. An upper surface of the HOUSING 22 is formed to a domed configuration so as to contact with the domed slider 24 of the SLIDING HEAD 21. The HOUSING 22 has an aperture at the center thereof for allowing the magnet holding part 25 to pass there through. In the HOUSING 22, a printed circuit board 28 is provided for wiring magnetically reluctant elements 27 and an electric switch 29.

At least two magnetically reluctant elements 27 are arranged on the printed circuit board 28, separated at equal distance from the central axis of the HOUSING 22 respectively. The magnetically reluctant elements 27 pick up a magnetic field of the MAGNET 26 respectively, producing electric signals regarding the position and moving speed of the pointer on the display. When the SLIDING HEAD 21 is slid, the magnetically reluctant elements 27 pick up the magnetic field respectively and produce electric signals in response to the slid direction and the slid amount of the SLIDING HEAD 21 from the central axis of the HOUSING 23. The electric signals from the magnetically reluctant elements 27 are processed for producing signals of the moving direction and speed of the pointer on the display. Namely, the moving direction and speed of the pointer are designated by the slid direction and distance of the SLIDING HEAD 21 from the central axis of the HOUSING 22 respectively. The magnetically reluctant elements 27 are for detecting the position and moving speed of the pointer on the display. Therefore, the magnetically reluctant elements 27 can be called "pointer co-ordinate position detectors" generally.

The electric switch 29 is mounted on the PCB 28 so as to be on the central axis of the HOUSING 22 for performing a click operation of the sliding head type pointing device 200. When the depressed portion of the RUBBER 23 is pushed down, the electric switch 29 is pushed so that the electric switch 29 performs the click operation.

Not depicted in FIG. 2, the sliding head type pointing device 200 has a mechanism for returning the SLIDING HEAD 21 to the center position when the SLIDING HEAD 21 is freed from the operator's finger. The mechanism will be called a "returning mechanism" hereinafter. FIGS. 3A, 3B and 3C show several types of returning mechanisms in the sliding head type pointing device 200 of the prior art. In FIG. 3A, a garter belt spring (GARTER-BELT SPRING) (33) having the configuration of a garter belt is hooked alternatively among a plurality of ("four" in FIG. 3A) poles (31 and 32) provided inside the SLIDING HEAD 21 and four on the HOUSING 22 respectively. By virtue of tensile strength of the GARTER BELT SPRING 33, the SLIDING HEAD 21 intends to return to the center position of the HOUSING 22 when the SLIDING HEAD 21 is freed. In FIG. 3B, instead of the GARTER BELT SPRING 33 used in FIG. 3A, a plurality of ("four" in FIG. 3B) straight springs (STRAIGHT SPRINGs) (36) having the same tensile strength are respectively hooked between hooks 31 and 32 neighbored to each other. By virtue of the tensile strength of the STRAIGHT SPRINGs 36, the SLIDING HEAD 21 intends to return to the center position when the SLIDING HEAD 21 is freed. In FIG. 3C, in order to couple the SLIDING HEAD 21 with the HOUSING 22, a coil-forced spring (COIL SPRING) (35) is provided between the SLIDING HEAD 21 and a spring holder (34) provided to the HOUSING 22 along the central axis of the HOUSING 22. By virtue of the restoring force of the COIL SPRING 35, the SLIDING HEAD 21 intends to return to the center position when the SLIDING HEAD 21 is freed.

Thus, when the SLIDING HEAD 21 is freed, the SLIDING HEAD 21 intends to return to the center position on the central axis of the HOUSING 22 by the returning mechanism. However, in either case of FIGS. 3A, 3B or FIG. 3C, since the spring is laid between the SLIDING HEAD 21 and the HOUSING 22, the SLIDING HEAD 21 is returned to the center position only by the restoring force of the spring. Therefore, if the restoring force of the spring is strengthened, the SLIDING HEAD 21 becomes hard to be handled, and if the restoring force of the spring is weakened, the SLIDING HEAD 21 becomes hard to be returned. In particular, when the SLIDING HEAD 21 is slid a small amount, the SLIDING HEAD 21 is hard to be returned to the center position. Since the sliding head type pointing device has been a representative attached type pointing device, it can be concluded that the returning accuracy of the attached type pointing device has been low in the prior art.

As described with reference to FIG. 2, the moving direction and speed of the pointer on the display can be changed in any value in an analog fashion. Namely, the MAGNET 26 and the magnetically reluctant elements 27 formulate analog pointing system in compliance with analog pointing software. However, there is other pointing system called digital pointing system operating under digital pointing software. The digital pointing system is required for, for example, a high speed game. In case of the digital pointing system, the pointer moves on the display digitally a predetermined distance every step, in a predetermined direction such as up, down, right, left or diagonal direction of those. Therefore, in the digital pointing system, only a switching function is enough to move the pointer. As a result, in order to operate both the analog pointing system and the digital pointing system with one terminal box, another pointing device called "switching type pointing device" is required to be added to the terminal box for the digital pointing system. This causes troubles that the terminal box becomes complex in operation and large in size.

SUMMARY OF THE INVENTION

Therefore, an object of the present invention is to increase the returning accuracy of the attached type pointing device.

Another object of the present invention is to improve the returning mechanism so that the movable member never moves by reason of the vibration or the shock added to the attached type pointing device freed from the finger's touch or the change of the posture of the attached type pointing device against gravity.

Another object of the present invention is to make the size and weight of the attached type pointing device small and light respectively so that the attached type pointing device can be mounted to a small box such as the terminal box of the amusement computer and the attached type pointing device can be handled easily.

Another object of the present invention is to make the attached type pointing device operate in compliance with both analog and digital pointing software.

Still another object of the present invention is to simplify a structure of the attached type pointing device, for increasing the operational reliability and decreasing the manufacturing cost.

The above objects are accomplished by improving the returning mechanism of the attached type pointing device. The invented attached type pointing device consists of a manually actuating movable member, a supporting member and a movement converting mechanism placed between the movable member and the supporting member.

In the above constitution of the invention first, a very important feature is that the attached type pointing device has a central axis established at the supporting member, and second, there are two different points from the sliding head type pointing device of the prior art, one is that the movable member has a center shaft sustained by a sustainer provided at the supporting member so as to be on the central axis and the other is that the movement converting mechanism is newly provided as the returning mechanism, for obtaining very high returning accuracy of the movable member.

By virtue of providing the center shaft, when the movable member is moved by the operator's finger, the center shaft can be tilted about the pivot sustainer.

By virtue of providing the movement converting mechanism, transversely tilting movement of the center shaft of the movable member is converted to longitudinally cylindrical sliding movement made along the central axis. Wherein, the cylindrical sliding movement is always forced toward the supporting member by a helical spring provided to the cylindrical sliding mechanism. When the movable member is freed from the operator's finger after the pointer has been moved, by virtue of converting the transversely tilting movement to the longitudinally sliding movement and appropriately adjusting the force of the helical spring, the center shaft of the movable member is securely returned to a former position on the central axis. Namely, by virtue of adopting the center shaft and the movement converting mechanism to the tilting head type pointing device, the high returning accuracy can be realized.

When the attached type pointing device according to the present invention works under the analog pointing system, similar to the sliding head type pointing device, a magnet is buried in the center shaft of the movable member as the pointer positioning element and magnetically reluctant elements are set on the printed circuit board, namely near by the magnet, as the pointer co-ordinate position detectors. The magnet is positioned on the central axis when the movable member is freed. The magnetically reluctant elements are arranged so as to be separated at equal distance from the central axis. The magnetically reluctant elements pick up a magnetic field of the magnet respectively and produce electric signals regarding the pointer position and the moving speed of the pointer on the display.

When the attached type pointing device works under the digital pointing system, it is only required that the movable member is used for turning switches ON. That is, it is not necessary to use the pointer positioning element and the magnetically reluctant elements, it is only required to use the movement converting mechanism for obtaining the high returning accuracy of the center shaft and to make switches ON-OFF under the digital pointing system.

Considering the above, a moving mechanism is added to the invented attached type pointing device so as to be fixed to the bottom of the pointing device, for moving the switches up and down. When the attached type pointing device operates under the analog pointing system, the switches are lowered so as not to be operated, and when the pointing device operates under the digital pointing system, the switches are raised so as to be operated. By virtue of mechanically adding the moving mechanism to the attached type pointing device, the attached type pointing device can be operated under both analog and digital pointing system.

BRIEF DESCRIPTION OF THE DRAWINGS

FIGS. 7 and 7A are partially cross-sectional and dismantled perspective view, respectively, of a tilting head type pointing device, for illustrating a preferred second embodiment of the present invention;

DESCRIPTION OF THE PREFERRED EMBODIMENT

Figure 4:
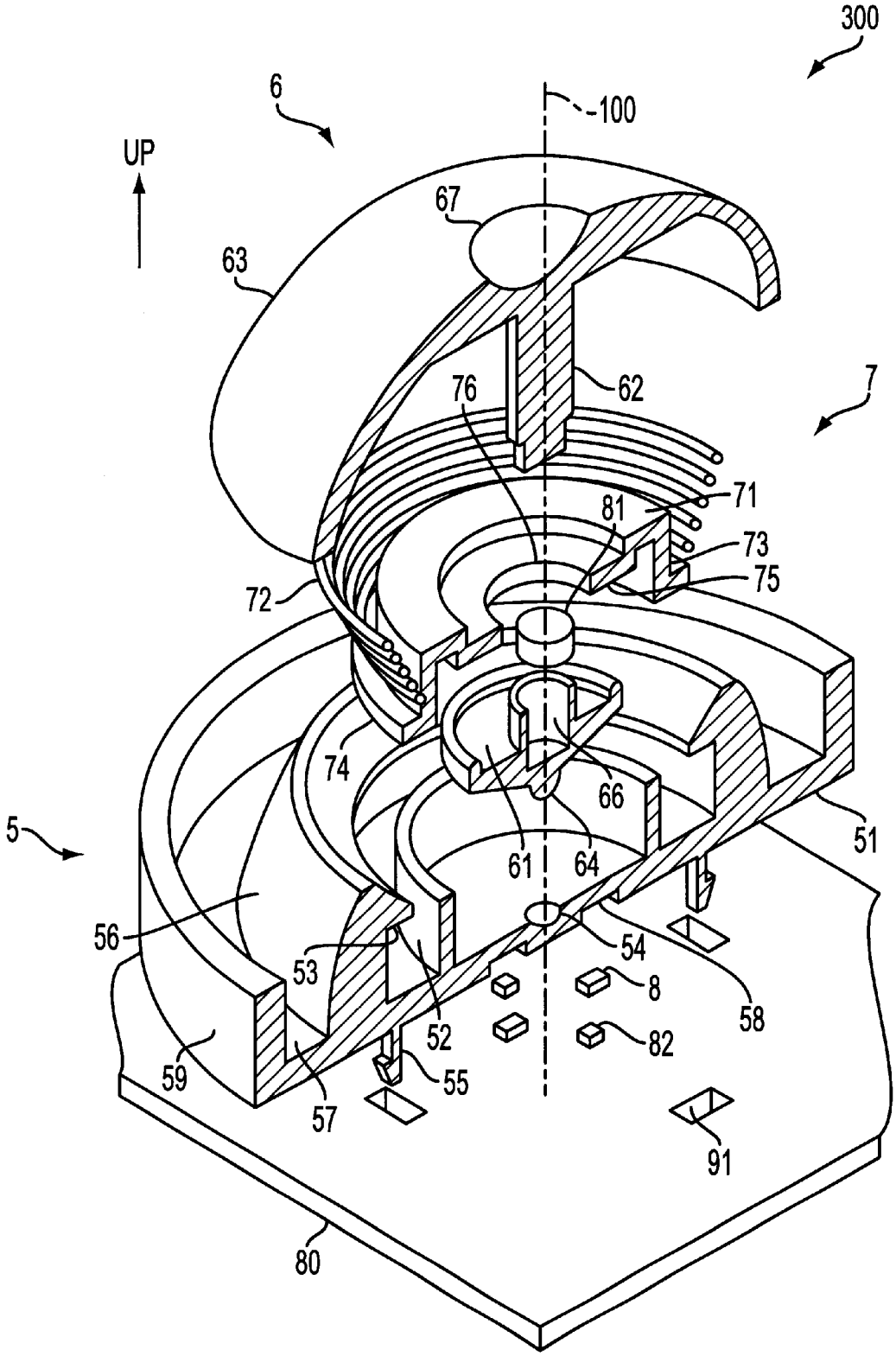
FIG. 4 is a partially cross-sectional and dismantled perspective view of the tilting head type pointing device 300, for illustrating a preferred first embodiment of the present invention.
Figure 5:
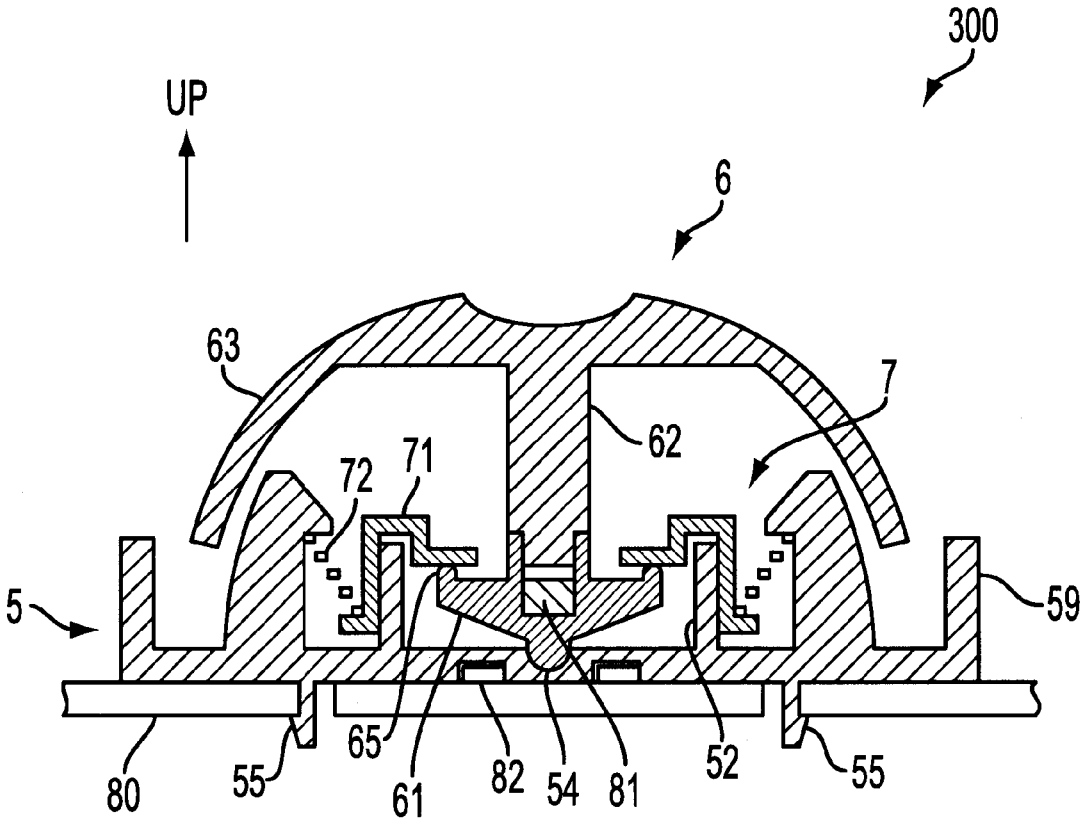
FIG. 5 is a sectional side elevation view of the tilting head type pointing device of the first embodiment, for illustrating the operation of the movable member freed from the operator's finger.
Figure 6:
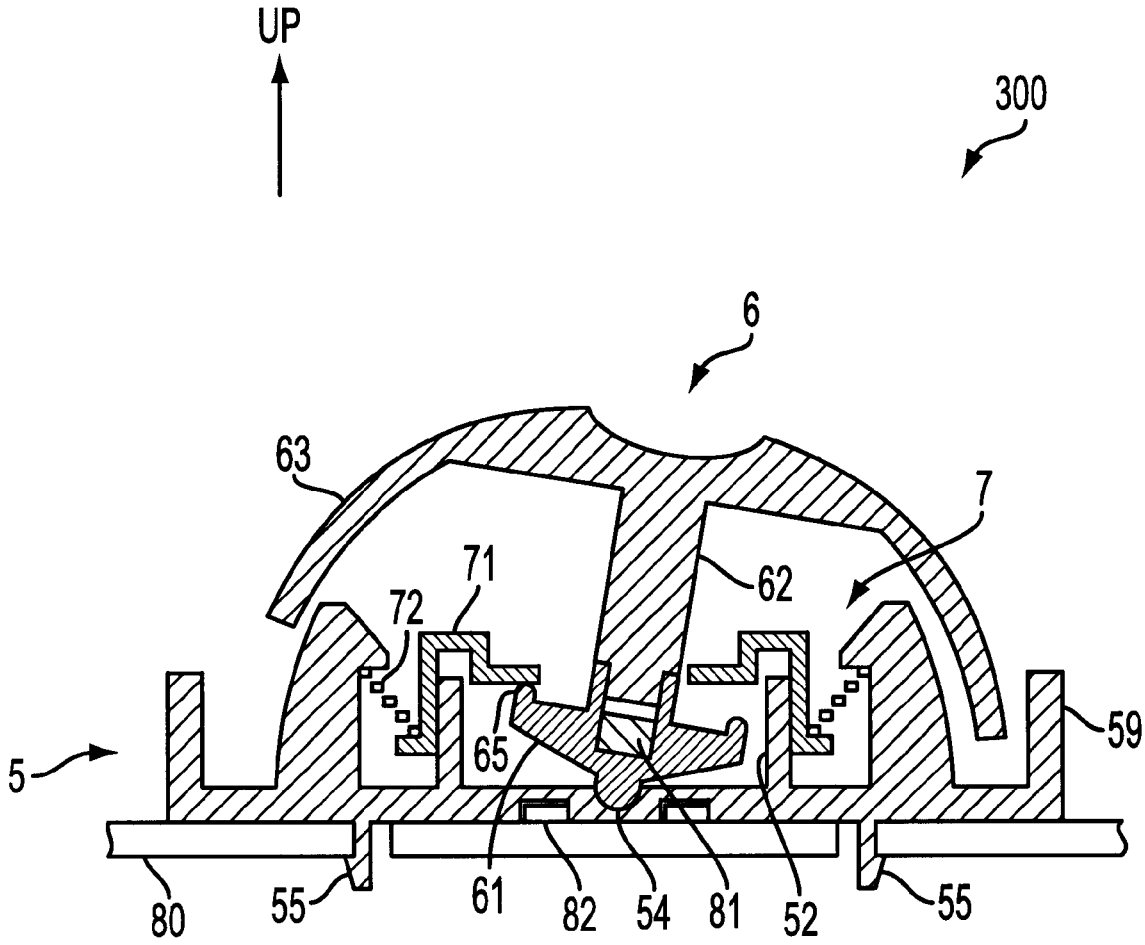
FIG. 6 is a sectional side elevation view of the tilting head type pointing device of the first embodiment, for illustrating the operation of the movable member tilted by the operator's finger.

A preferred embodiment of the attached type pointing device of the present invention in the case where the pointing device operates under the analog pointing system is shown in FIGS. 4, 5 and 6 as a first embodiment, and another preferred embodiment of the attached type pointing device of the present invention in the case where the pointing device operates under either the analog or the digital pointing system is shown in FIGS. 7, 8, 9 and 10 as a second embodiment. Throughout FIGS. 4 to 10, the same reference numeral designates the same elements.

FIG. 4 is a partially cross-sectional and dismantled perspective view of the attached type pointing device according to the first embodiment, FIG. 5 is a sectional side elevation view in case where a movable member of the pointing device is freed from the operator's finger, and FIG. 6 is a sectional side elevation view in case where the movable member is moved by the operator's finger. The movable member of the pointing device has a head which can be manually tilted. For this reason, the attached type pointing device will be called a "tilting head type pointing device" hereinafter. In FIGS. 4, 5 and 6, the mechanism of the tilting head type pointing device will be described but the analog pointing system itself is omitted.

Figures 7A, 7B:
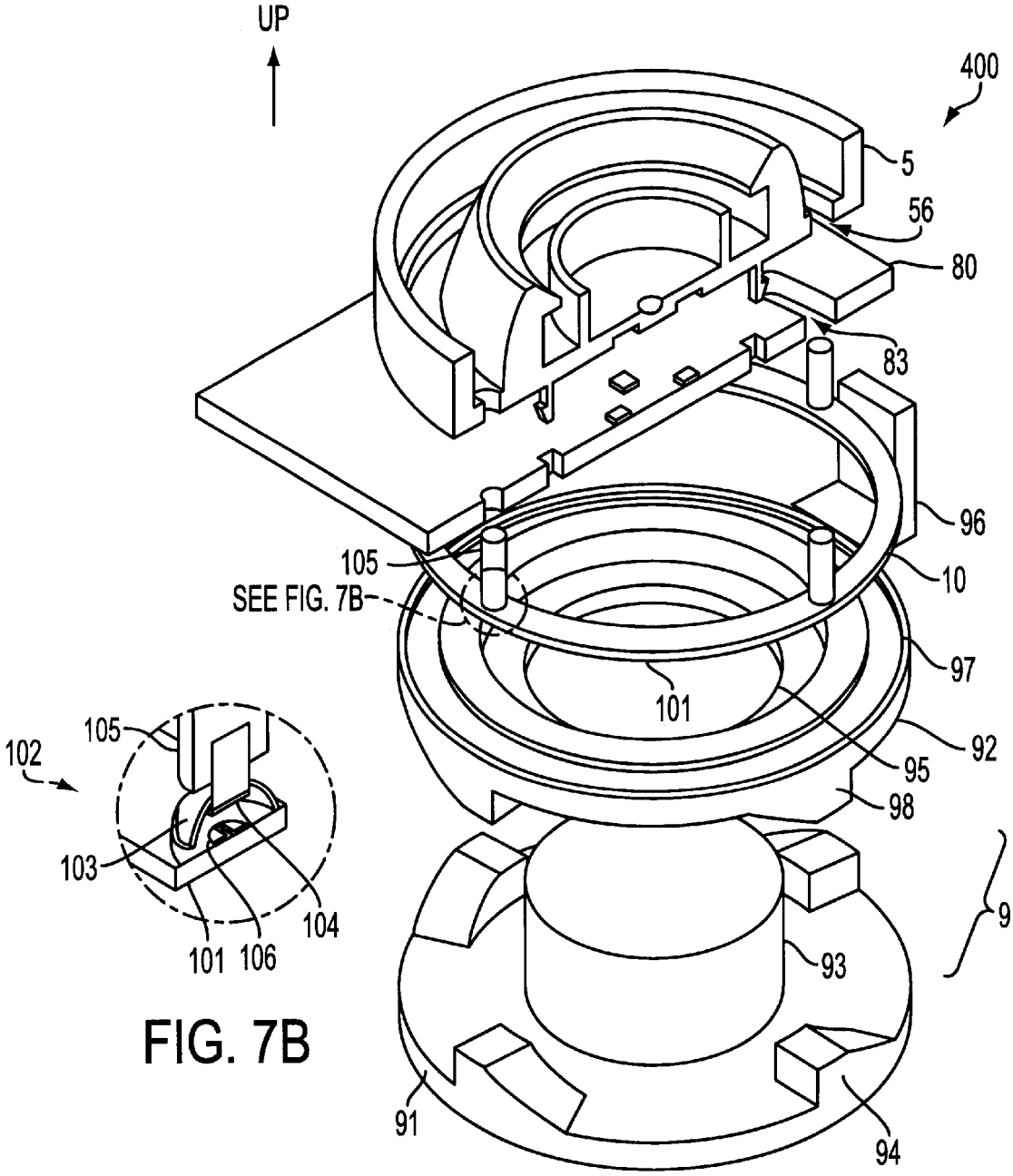
Figure 8:
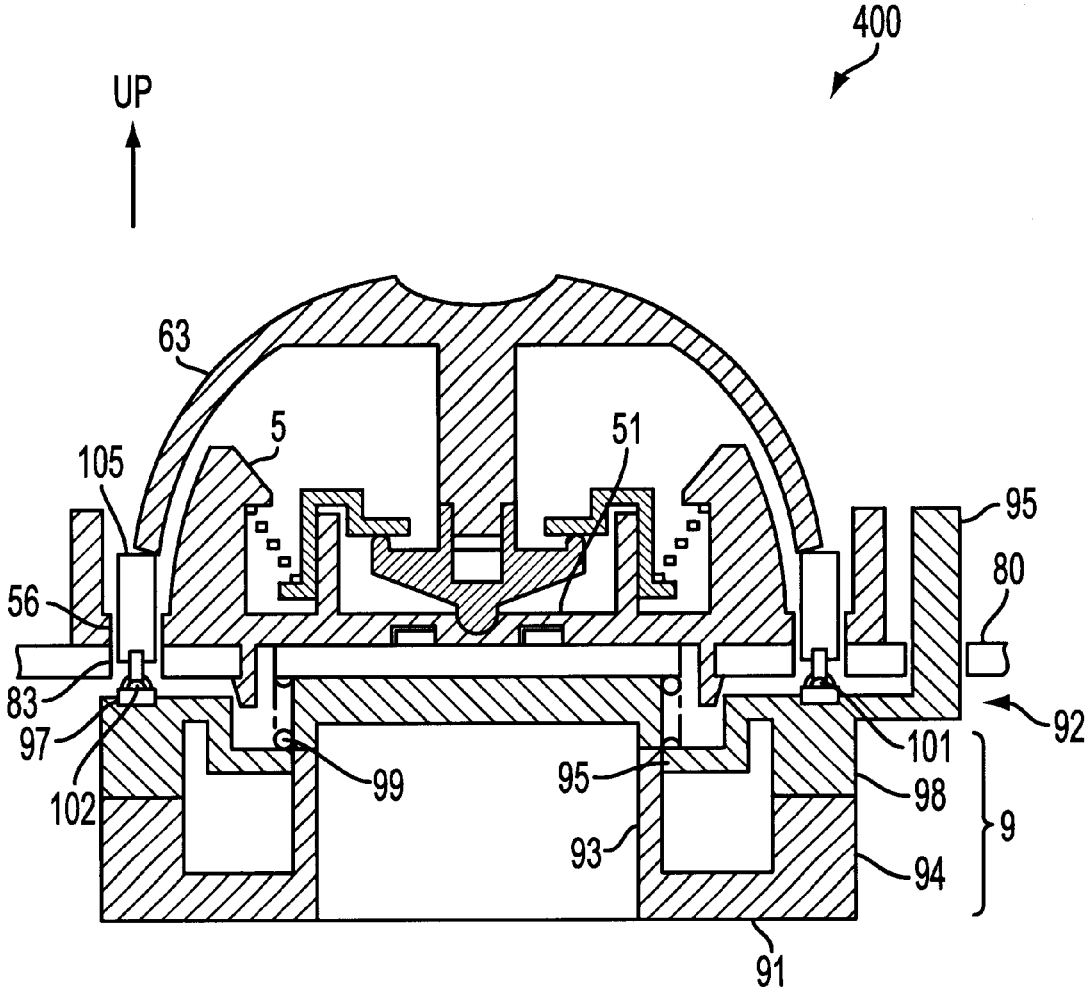
FIG. 8 is a sectional side elevation view of the tilting head type pointing device of the second embodiment, for illustrating operation of a moving mechanism and a switching unit for the second embodiment in case where the pointing device of the second embodiment operates under the digital pointing system and the movable member is freed from touching.
Figure 9:
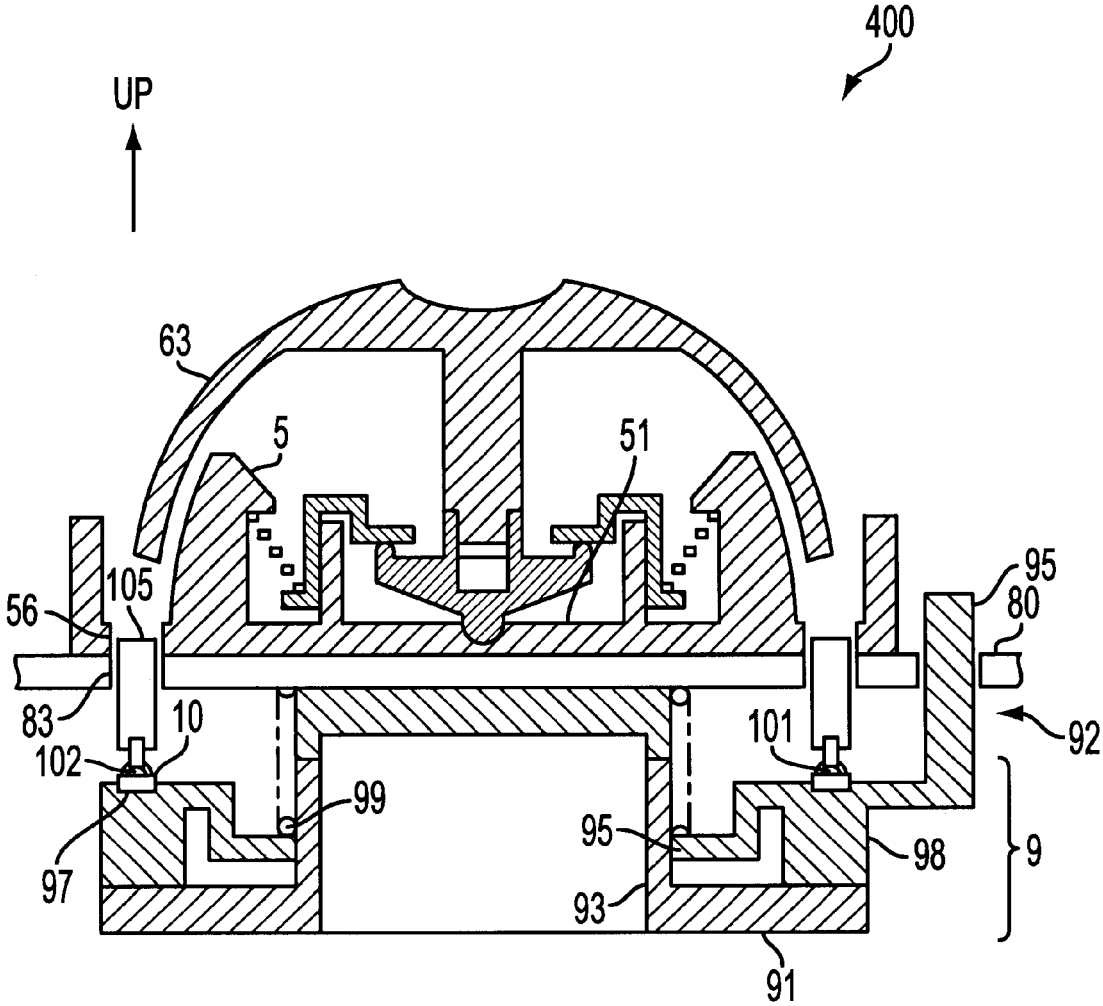
FIG. 9 is a sectional side elevation view of the tilting head type pointing device of the second embodiment, for illustrating the operation of the moving mechanism and the switching unit for the second embodiment in case where the pointing device of the second embodiment operates under the analog pointing system and the movable member is freed from touching.

FIG. 7 is a partially cross-sectional and dismantled perspective view of the attached type pointing device according to the second embodiment, FIG. 8 is a sectional side elevation view of the attached type pointing device of the second embodiment in case where the pointing device operates under the digital pointing system, and FIG. 9 is the same but in case where the pointing device operates under the analog pointing system. In reference to FIGS. 7, 8 and 9, the moving mechanism and the switching unit will be described but the digital pointing system itself is omitted to be detailed because of the prior art.

In order to describe the structure and function of the pointing device, a word such as "up", "upward", "down", "downward", "top" or "bottom" will be used in compliance with an arrow marked "UP" depicted respectively in all figures in this specification.

As shown in FIG. 4, a tilting head type pointing device (300) includes a manually actuating movable member (MOVABLE MEMBER) (6), a supporting member (SUPPORT MEMBER) (5), and movement converting mechanism (MOVE-CONVERT MECHANISM) (7). The MOVABLE MEMBER 6 is for manually moving and pointing the pointer on the display by the operator's finger. The SUPPORTING MEMBER 5 is for supporting the MOVABLE MEMBER 6 and the MOVE-CONVERT MECHANISM 7 on the basis of a central axis (CENTRAL AXIS) of the SUPPORTING MEMBER 5 and mounting the tilting head type pointing device 300 to a printed circuit board (PCB) (80). The MOVE-CONVERT MECHANISM 7 is for converting the tilt motion of the MOVABLE MEMBER 6 to the longitudinal sliding motion made in the direction of the CENTRAL AXIS 100.

The MOVABLE MEMBER 6 consists of a center shaft (CENTER SHAFT) (62), a tilting head (TILTING HEAD) (63) connected with the CENTER SHAFT 62, a permanent magnet (MAGNET) (81), and a magnet holder (HOLDER) (61) connected to the CENTER SHAFT 62 with the MAGNET 81.

The TILTING HEAD 63 is shaped like a dome or turned over cap having an inward depressed portion (67) at a center thereof. The CENTER SHAFT 62 can be tilted by the operator's finger touching the depressed portion 67. The HOLDER 61 has a sleeve at the center thereof, in which the CENTER SHAFT 62 is inserted with the MAGNET 81. The MAGNET 81 is provided as the pointer positioning element which is described in reference with FIG. 2. The HOLDER 61 has a pivot (PIVOT) (64) having a half-spherical tip at the bottom and center of the HOLDER 61. The PIVOT 64 is firmly set in a pivot sustainer (SUSTAINER) (54) provided at the center of the SUPPORT MEMBER 5, on the CENTRAL AXIS 100. By virtue of the PIVOT 64 and the SUSTAINER 54, the CENTER SHAFT 62 can be tilted omni-directionally in a direction, which will be called the "tilt direction" hereinafter, around the CENTRAL AXIS 100 and at an angle, which will be called "tilt angle" hereinafter, from the CENTRAL AXIS. The HOLDER 61 has another function relating to the MOVE-CONVERT MECHANISM 7. The HOLDER 61 has a round rim (RIM) (65) looking upward, at an edge of a round brim spread from the CENTER SHAFT 62. When the CENTER SHAFT 62 is tilted, the RIM 65 pushes up the MOVE-CONVERT MECHANISM 7 which results in converting the tilt motion of the MOVABLE MEMBER 6 to the longitudinal sliding motion.

The MOVE-CONVERT MECHANISM 7 includes of a slider (SLIDER) (71) and a spiral spring (SPRING) (72). The SLIDER 71 consists of a cylinder (CYLINDER) (73), a hole (76) made at the center of the SLIDER 71 for passing the CENTER SHAFT 62 therethrough even when the CENTER SHAFT 62 of the MOVABLE MEMBER 6 is tilted about the SUSTAINER 54, a disk part (DISK) (75) spread between the hole 76 and the CYLINDER 73 so that the lower surface of the DISK 75 is always contacted with the RIM 65 of the HOLDER 61 by the downward force of the SPRING 72, and a round flange (FLANGE) (74) stretched out from the CYLINDER 73 at the bottom of the CYLINDER 73 for stopping the SPRING 72. The action of the downward force of the SPRING 72 will be explained later in reference to FIGS. 5 and 6.

The SUPPORT MEMBER 5 mainly includes a round base (BASE) (51), a round cylinder guide (CYLINDER GUIDE) (52) and a round housing (HOUSING) (56). The CYLINDER GUIDE 52 and the HOUSING 56 stand on the BASE 51 in the same direction as the CENTRAL AXIS. The BASE 51 is for mounting the tilting head type pointing device 300 on the PCB 80, on the basis of the CENTRAL AXIS 100. At the BASE 51, the SUSTAINER 54 is provided at a center of the BASE 51 so as to be on the CENTRAL AXIS 100, four hooks (HOOKS) (55) are provided for fixing the BASE 51 to the PCB 80, a brim (BRIM) (57) is expanded at the periphery of the BASE 51 so as to be used as a tilt stopper of the TILTING HEAD 63, and four hollows (58) are provided on a bottom surface for allowing four magnetically reluctant elements (82) to be mounted on the PCB 80. The CYLINDER GUIDE 52 stands on the BASE 51 for guiding the CYLINDER 73 of the MOVE-CONVERT MECHANISM 7. The HOUSING 56 is for housing the MOVE-CONVERT MECHANISM 7. The upper surface of the HOUSING 56 is slanted downward and inward and a hook

(53) is provided under the slanted surface, for installing and fixing the MOVE-CONVERT MECHANISM 7 in the HOUSING 56, which will be fully explained later.

Figure 1:
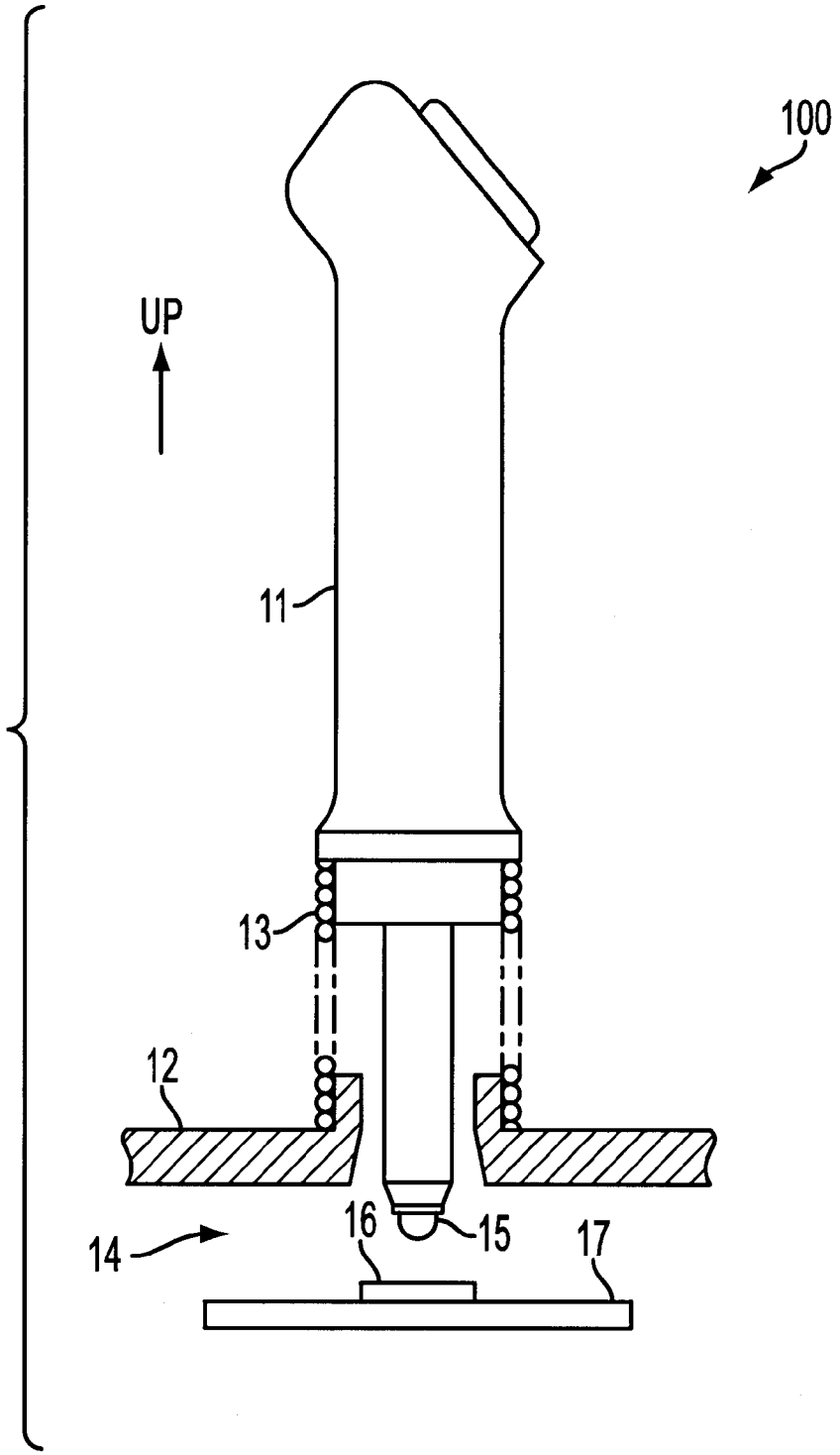
FIG. 1 (PRIOR ART)
FIG. 1 is a schematic side view of the joystick type pointing device 100 of the prior art.
Figure 2:
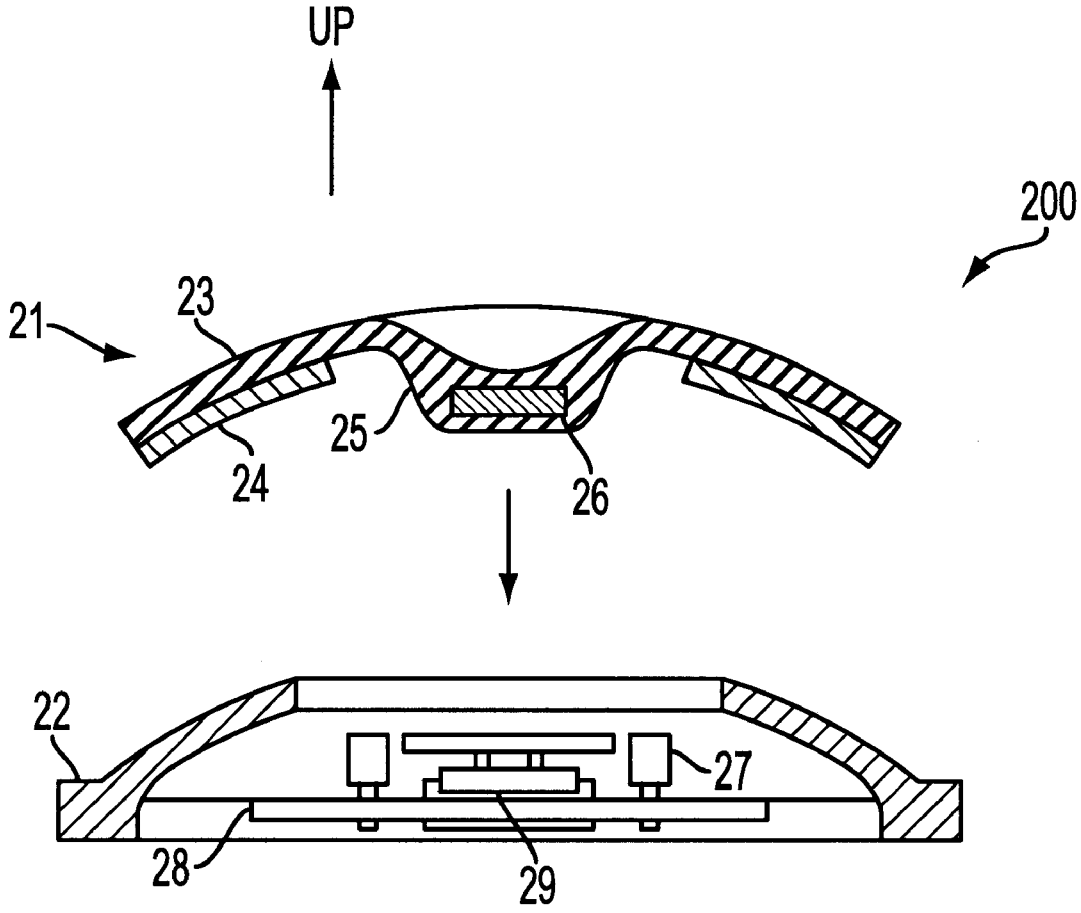
FIG. 2 (PRIOR ART)
FIG. 2 is a schematic side view of the sliding head type pointing device (200) of the prior art.
Figure 3A:
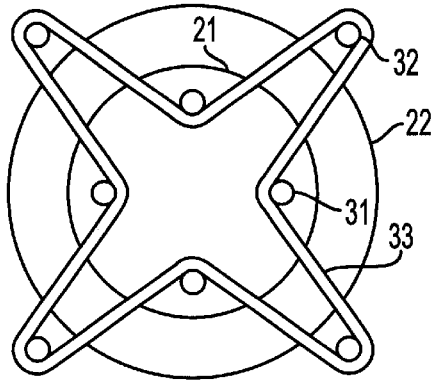
FIG. 3A (PRIOR ART)
FIG. 3A is a schematic figure for illustrating a returning mechanism using a garter-belt spring.
Figure 3B:
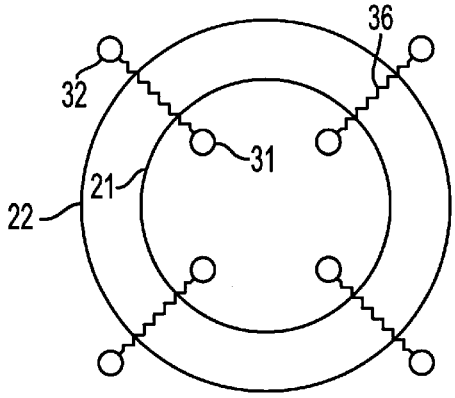
FIG. 3B (PRIOR ART)
FIG. 3B is a schematic figure for illustrating a returning mechanism using four straight springs.
Figure 3C:
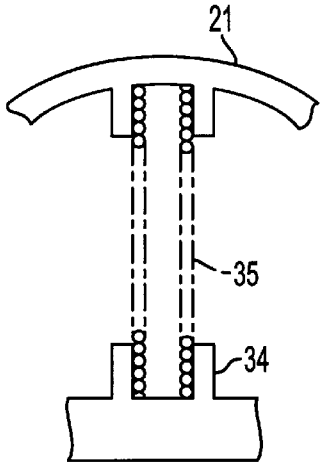
FIG. 3C (PRIOR ART)
FIG. 3C is a schematic figure for illustrating a returning mechanism using a coil spring.

On the PCB 80, four magnetically reluctant elements 82 are mounted as the pointer co-ordinate position detectors (8) similar to the magnetically reluctant elements 27 of the sliding head type pointing device 200 shown in FIG. 2. Four holes (91) are provided for hooking the hooks 55 so that the center of the BASE 51 coincides with the arrangement center of the magnetically reluctant elements 82. The magnetically reluctant elements 82 are arranged on the PCB 80 so as to be separated respectively with equal distance from the center of the BASE 51 fixed to the PCB 80. Similar to the sliding head type pointing device 200 shown in FIG. 2, the magnetically reluctant elements 82 produce the electric signal of the co-ordinate position of the pointer and the moving speed of the pointer on the display, in cooperation with a position of the MAGNET 81 buried in the HOLDER 61.

The MOVABLE MEMBER 6, the MOVE-CONVERT MECHANISM 7 and the SUPPORT MEMBER 5 are assembled to the tilting head type pointing device 300 in accordance with the following numbered steps:

(1) the HOLDER 61 is assembled by putting the MAGNET 81 in the hole 66;

(2) the HOLDER 61 including the MAGNET 81 is inserted into the SUPPORTING MEMBER 5 so that the PIVOT 64 is set in the SUSTAINER 54;

(3) the MOVE-CONVERT MECHANISM 7 is partially assembled by putting the SPRING 72 on the CYLINDER 73;

(4) the partially assembled MOVE-CONVERT MECHANISM 7 is put into the SUPPORT MEMBER 5 by sliding the CYLINDER 73 into the GUIDE 52 of the SUPPORT MEMBER 5 and putting the SPRING 72 between the hook 53 of the HOUSING 56 and the FLANGE 74 of the SLIDER 71 against the spread force of the SPRING 72, so that the HOLDER 61 sustained by the SUSTAINER 54 through the PIVOT 64 is kept down by the SPRING 72;

(5) the tilting head type pointing device 300 is discretely assembled by pushing the CENTER SHAFT 62 of the MOVABLE MEMBER 6 into the hole 62 of the HOLDER 61 with the MAGNET 81; and (6) the discretely assembled tilting head type pointing device 300 is mounted on the PCB 80 by inserting the HOOKS 55 of the SUPPORT MEMBER 5 into the holes 91 of the PCB 80 on which the magnetically reluctant elements 82 and other circuits associated with the magnetically reluctant elements 82 are previously set on and printed.

The tilting head pointing devices 300 mounted on the PCB 80 are illustrated in FIGS. 5 and 6 in cross-sectional views. FIG. 5 illustrates a case where the MOVABLE MEMBER 6 is not tilted because of no operator's finger-touch to the TILTING HEAD 63. That is, the MOVABLE MEMBER 6 stands by itself by virtue of the extension force of the SPRING 72. FIG. 6 illustrates a case where the MOVABLE MEMBER 6 is tilted because of operator's finger-touch to the TILTING HEAD 63.

In FIG. 5, because of no operator's touch to the TILTING HEAD 63, the CENTER SHAFT 62 of the TILTING HEAD 63 is freed. Therefore, by virtue of the expanding force of the SPRING 72 fitted between the hook 53 of the HOUSING 56 and the FLANGE 74 of the SLIDE 71, the DISK 75 of the SLIDER 7 pushes the RIM 65 of the HOLDER 61 down in the direction of the CENTRAL AXIS of the SUPPORT MEMBER 5. As a result, the CENTER SHAFT 62 stands in the direction of the CENTRAL AXIS perpendicularly to a bottom surface of the BASE 51 of the SUPPORT MEMBER 5. Since the SPRING 72 always pushes all around the RIM 65 through the DISK 75, when the weight of the MOVABLE MEMBER 6 is lightened and the expanding force of the SPRING 72 is selected properly, vibration of the MOVABLE MEMBER due to the shock or the mechanical vibration added to the tilting head type pointing device 300 can be avoided. The CENTER SHAFT 62 inclines from the CENTRAL AXIS of the SUPPORT MEMBER 5 due to the posture of the tilting head type pointing device 300 against gravity.

In FIG. 6, when the MOVABLE MEMBER 6 is moved, the CENTER SHAFT 62 is tilted about the SUSTAINER 54 in a tilt direction (on the right in FIG. 6). Then, the RIM 65 pushes the DISK 75 (accordingly the SLIDER 71) up in the direction of the CENTRAL AXIS of the SUPPORT MEMBER 5 against the extending force of the SPRING 72. Namely, when the CENTER SHAFT 62 inclines about the SUSTAINER 54, the RIM 65 pushes the SLIDER 71 through the DISK 75. However, since the SLIDER 71 is restricted to move only in the direction of the CENTRAL AXIS by the CYLINDER 73 sliding on the GUIDE 52 of the SUPPORT MEMBER 5, the tilt movement of the MOVABLE MEMBER 6 is converted to the movement in the direction of the CENTRAL AXIS of the SUPPORT MEMBER 5. When the TILTING HEAD 63 is freed from the operator's touch, the CENTER SHAFT 62 is brought back to the position of the CENTRAL AXIS as shown in FIG. 5.

When the MOVABLE MEMBER 6 is moved, the MAGNET 81 stored in the CENTER SHAFT 62 changes its spatial position, and the changed position of the MAGNET 81 is detected by the magnetically reluctant elements 82 mounted on the PCB 80. Namely, the tilt direction and angle of the CENTER SHAFT 62 are detected by the magnetically reluctant elements 82. The magnetically reluctant elements 82 produce electric signals from which the moving direction and speed of the pointer on the display are determined. These are the same as the relation between the MAGNET 26 and the magnetically reluctant elements 27 in the sliding head type pointing device 200 described in reference with FIG. 2. The tilt angle of the TILTING HEAD 63 is mechanically limited when the TILTING HEAD 63 hits the BRIM 57 of the BASE 51.

The second embodiment of the present invention is prepared by modifying the attached type pointing device of the first embodiment described as the tilting head type pointing device 300 in reference with FIGS. 4 to 6. The modification is performed by adding a moving mechanism and a switching unit to the tilting head type pointing device 300. The moving mechanism is for changing system from analog to digital system and vice versa by manually operating a lever on the moving mechanism. When the lever is turned to an analog mode, the switching unit is mechanically and functionally disconnected from the tilting head type pointing device 300, so that the tilting head type pointing device of the second embodiment operates the same as the tilting head type pointing device 300. When the lever is turned to a digital mode, the switching unit is connected with the TILTING HEAD 63 of the tilting head type pointing device 300, so that the pointing device of the second embodiment operates as a switching device, however keeping the returning mechanism of the tilting head type pointing device 300 in use.

FIGS. 7 and 7A are partially cross-sectional and dismantled perspective view of a moving mechanism (MOVING MECHANISM) (9) and a switching unit (SWITCH UNIT) (10) of a tilting head type pointing device (400), for illustrating the second embodiment of the present invention.

As shown in FIG. 7, the tilting head type pointing device 400 is constructed by adding the MOVING MECHANISM 9 and the SWITCH UNIT 10 to the tilting head type pointing device 300 shown in FIG. 4. Namely, the MOVING MECHANISM 9 is provided under the PCB 80 and the SWITCH UNIT 10 is provided between the PCB 80 and the MOVING MECHANISM 9. In FIG. 7, it is omitted to depict the details of the tilting head type pointing device 300.

The MOVING MECHANISM 9 consists of a stator (STATOR) (91) fixed to a lower surface of the PCB 80 and a rotor (ROTOR) (92) turned around the STATOR 91. The STATOR 91 consists of a post (93) fixed to the PCB 80 and a plurality of, four in FIG. 7, fixed cams (FIXED CAMs) (94) arranged around a base of the post 93. The ROTOR 92 has a center hole 95 through which the ROTOR 92 is fitted to the post 93 so that the ROTOR 92 can be turned around the post 93.

Figure 10:
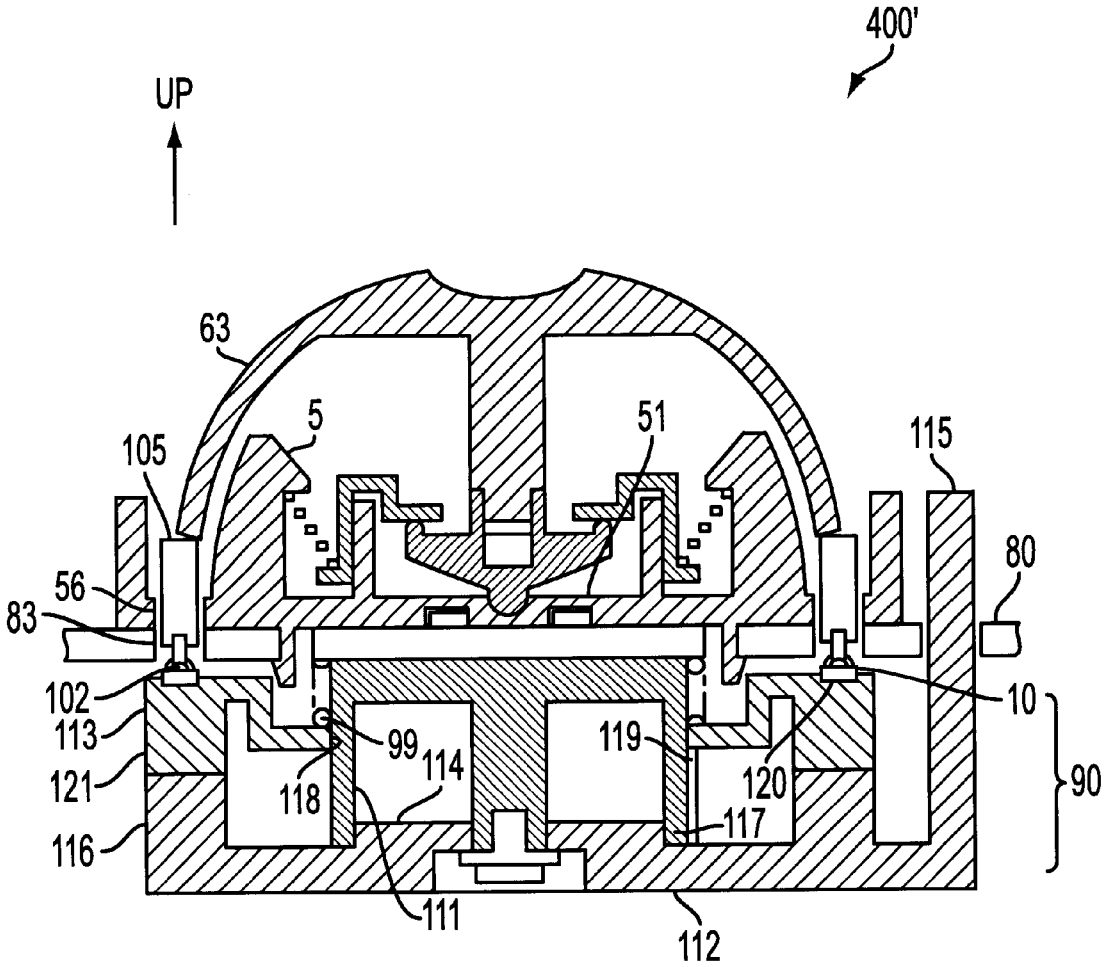
FIG. 10 is a sectional side elevation view of a modified tilting head type pointing device of the second embodiment, for illustrating the operation of a modified moving mechanism and switching unit for the second embodiment in case where the pointing device of the second embodiment operates under digital pointing system and the movable member is freed from touching.
Figure 4:
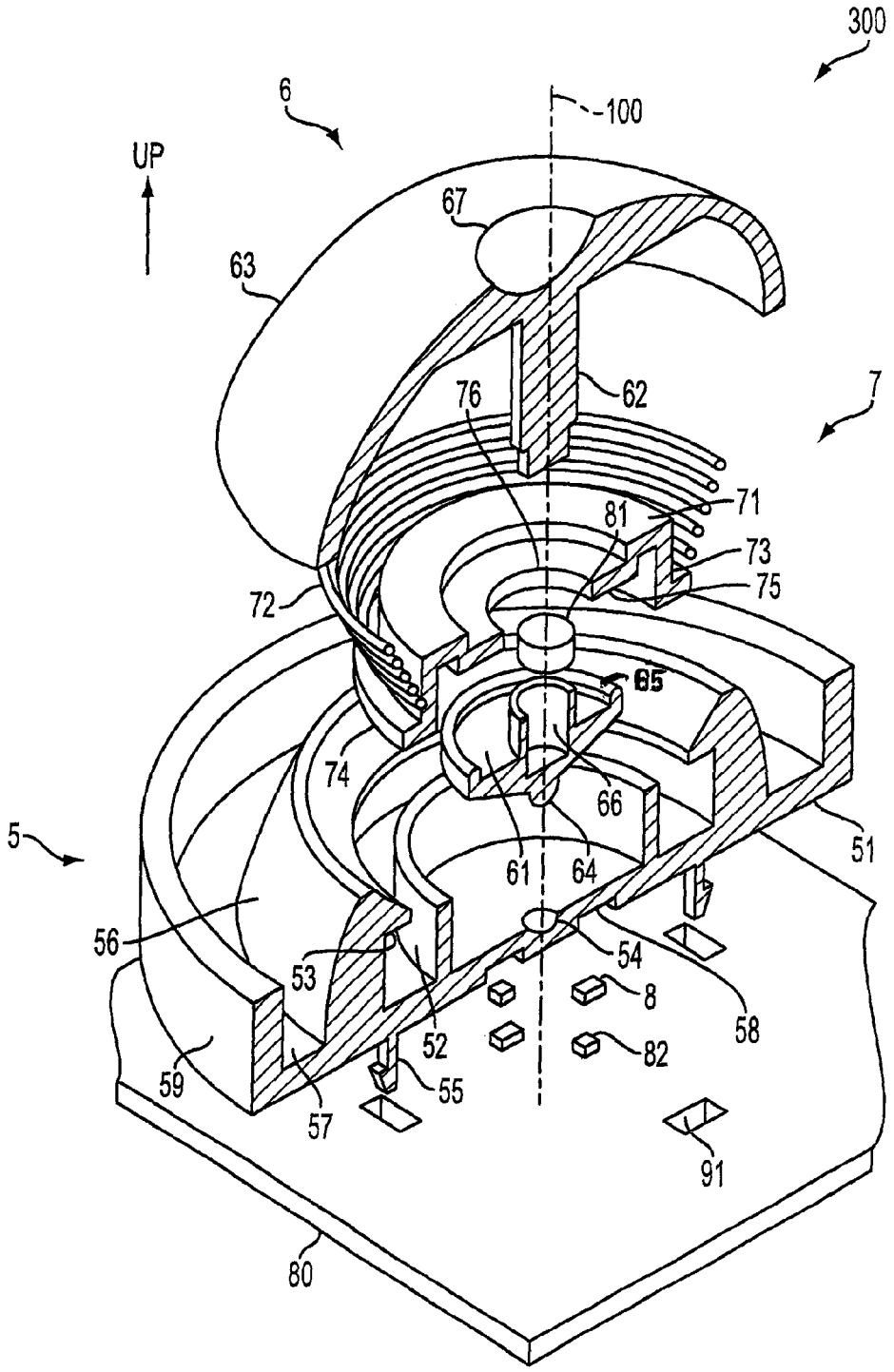
Figure 8:
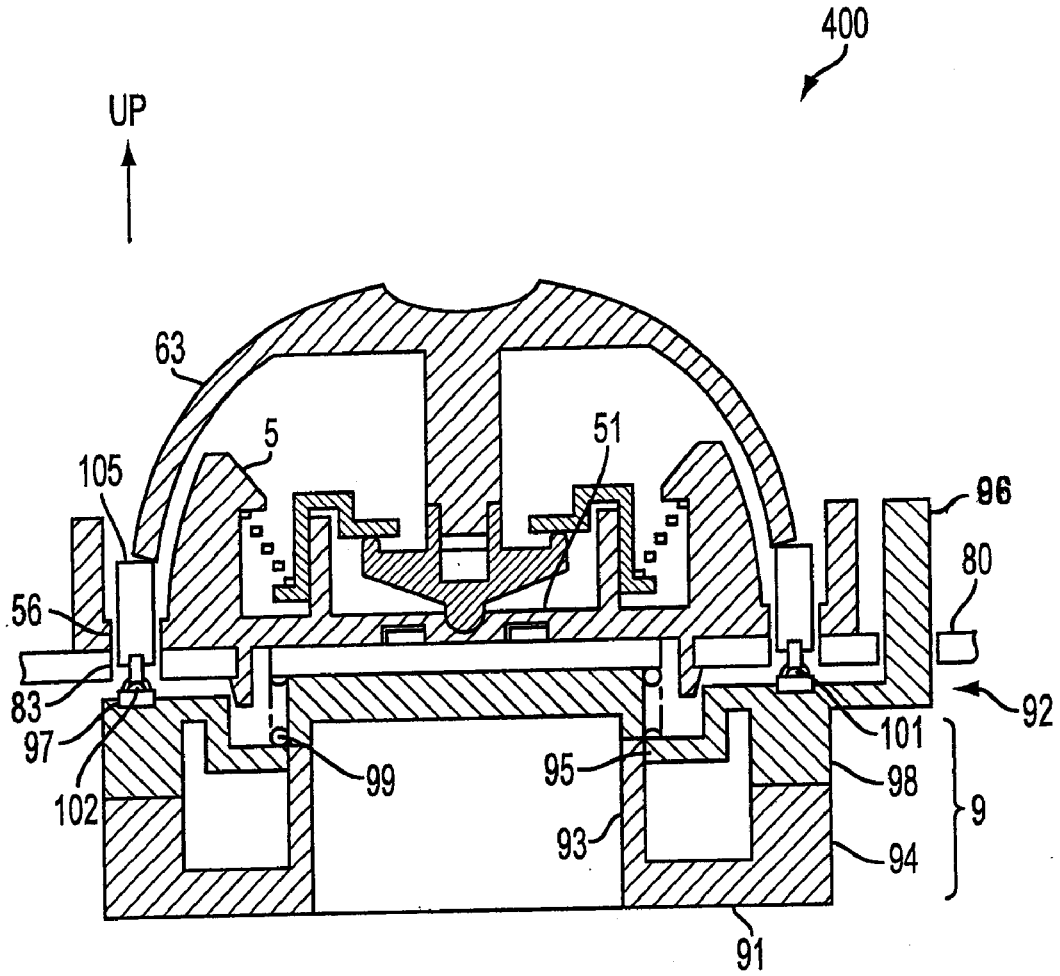
Figure 9:
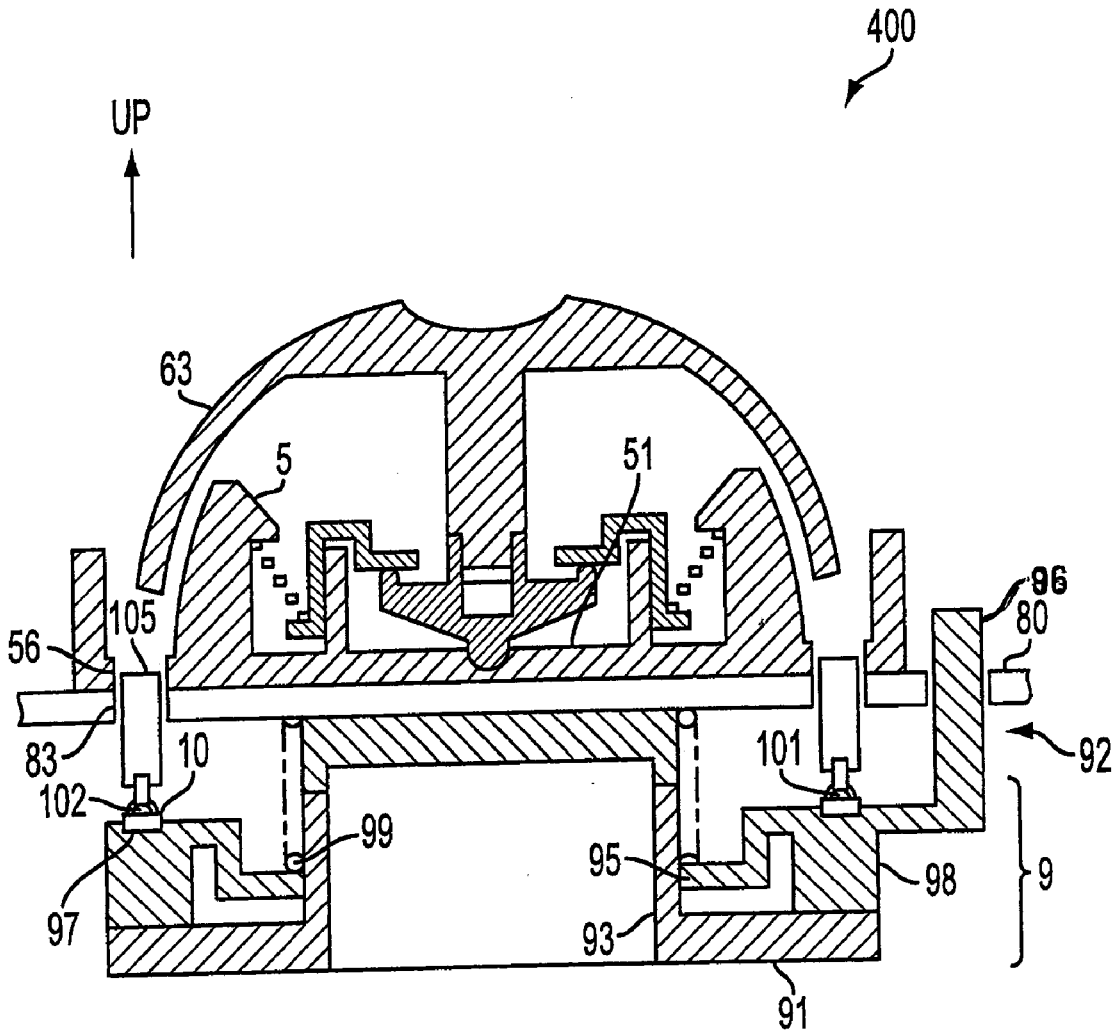

The ROTOR 92 consists of a rotary lever (LEVER) (96) projected from the ROTOR 92, a round ditch (97) provided to an upper face of the ROTOR 92 for sustaining the SWITCHING UNIT 10, and a plurality of, four in FIG. 7, rotating cams (ROTATING CAMs)(98) provided to a lower face of the ROTOR 92 so as to be contacted with the FIXED CAMs 94 respectively when the ROTOR 92 is turned. The ROTOR 92 is pushed to the STATOR 91 by a spring (SPRING) (99), which is not depicted in FIG. 7 but in FIGS. 8 to 10, provided between the PCB 80 and the ROTOR 92. By virtue of the SPRING 99, the ROTOR 92 can be raised up or lowered down by moving the LEVER 96 because of the combination works of the ROTATING CAMs 98 and the FIXED CAMs 94.

The SWITCH UNIT 10 consists of a ring board (101) fitted into the ditch 97 and plurality of, four in FIG. 7, switching elements (SWITCHes) (102) each having a domed actuator (103) made of, for example, rubber and a short electrode (104) fixed to the actuator 103. The SWITCHes 102 mounted on the ring board 101 are arranged in compliance with the pointing software used in the digital pointing system. A pole 105 is stood on each SWITCH 102 and a pair of electrodes (106) are provided in each SWITCH 102 so that the electrodes 106 are shorted by the short electrode 104 when the pole 105 pushes the actuator 103. The switching performed by the SWITCH 102 will be described with reference to FIGS. 8 and 9.

FIGS. 8 and 9 are sectional side elevation views of the tilting head type pointing device 400, FIG. 8 is for illustrating the pointing device 400 operating under the digital pointing system and FIG. 9 is for illustrating the pointing device 400 operating under the analog pointing system, in case where the TILTING HEAD 63 is free from the operator's touch, respectively.

In FIGS. 8 and 9, holes (56 and 83) are provided to the BASE 51 of the SUPPORT MEMBER 5 and the PCB 80 respectively, corresponding to the poles 105. When the ROTOR 92 is raised up by turning the LEVER 96 to the digital mode, the poles 105 are raised up so that each pole 105 can be pushed by the edge of the TILTING HEAD 63 when the TILTING HEAD 63 is tilted.

Therefore, when the TILTING HEAD 63 is tilted, the domed actuator 103 is pushed down by a pole 105. As a result, the domed actuator 103 acts pursuant to the operator's finger and the electrodes 106 are shorted, namely the SWITCH 102 is turned ON. This means that the tilting head type pointing device 400 operates only under the digital pointing system, keeping the high returning accuracy.

When the ROTOR 92 is brought down by turning the LEVER 96 to the analog mode, the poles 105 are sunk from the upper surface of the BASE 51, so that the SWITCHes 103 are not operated by the poles 105 even though the TILTING HEAD 63 is tilted. In this situation, the poles 105 are never pushed down by the edge of the TILTING HEAD 63, because the edge of the TILTING HEAD 63 is stopped at the upper surface of the BRIM 57 of the BASE 51 (see FIG. 4). This means that the tilting head type pointing device 400 operates only under the analog pointing system the same as the tilting head type pointing device 300 described with reference to FIGS. 4 to 6.

FIG. 10 is a sectional side elevation view of a tilting head type pointing device 400' which is also the second embodiment of the present invention. However, the pointing device 400' is made by modifying the tilting head type pointing device 400 so that the poles 105 are merely raised or brought down, not rotated with the rotating ROTOR 92, every time the LEVER (115) is turned to the analog mode or the digital mode. Namely, the modification is performed by changing the MOVING MECHANISM 9 of the tilting head type pointing device 400 to a MOVING MECHANISM (90) shown in FIG. 10.

In FIG. 10, line the MOVING MECHANISM 9, the MOVING MECHANISM 90 is fit to the lower surface of the PCB 80 together with the SWITCH UNIT 10. The MOVING MECHANISM 90 includes a fitting part (111) for fitting the MOVING MECHANISM 90 to the PCB 80 so that a central axis of the fitting part coincides with the CENTRAL AXIS 100 of the SUPPOTING MEMBER 5, a ROTOR (112) and a STATOR (113). Hereupon, usage of the rotor and the stator in FIG. 10 is reversed to that shown in FIG. 7. The STATOR 113 is set on the fitting part 111 so as to slide on a cylindrical outer surface of the fitting part 111 and is sustained by the ROTOR 112. The ROTOR 112 is set on the fitting part 111 by inserting a boss 114 of the ROTOR 112 into the fitting part 111 and screwing the ROTOR 112 to a center shaft of the fitting part 111 so that the ROTOR 112 can be rotated around the center shaft and on an inside cylindrical surface of the fitting part 111. The ROTOR 112 has a LEVER (115) projected from the ROTOR 112 proper, formed like an "L" letter and a plurality of ROTATING CAMs 116 are provided around the boss 114. The STATOR 113 has a hole (118) at a center thereof, through which the STATOR 113 is passed and the STATOR 113 has a projection (119) that protrudes inward across the hole 118. In order to insert the projection 119, a straight ditch (117) is provided on the outside cylindrical surface of the fitting part 111 in a direction parallel with the central axis of the fitting part 111. By virtue of inserting the projection 119 into the ditch 118, the STATOR 113 can be slid up and down on the surface of the fitting part 111 without rotation. A spring (SPRING) 99 is provided between the PCB 80 and the STATOR 113 for pushing the STATOR 113 to the ROTOR 112. By virtue of extending force of the SPRING 99, when the LEVER 115 is turned to the analog mode, the STATOR 113 is slid down, and when the LEVER 115 is turned to the digital mode, the STATOR 113 is slid up, without play between the STATOR 113 and the ROTOR 112. Different from the tilting head type pointing device 400, in the tilting head type pointing device 400', the poles 105 of the SWITCH UNIT 10 simply moves up and down, making the up-down movement of the poles 105 smooth.

What is claimed is:

1. A pointing device for moving a pointer on a display, said pointing device comprising:

a supporting member to support and mount the pointing device on an object, said supporting member including a sustainer positioned on a central axis of said supporting member and a cylinder guide positioned around the central axis of said supporting member;

a movable member manually actuated for moving the pointer toward a required point on the display at a required speed, said movable member including a center shaft enabling manual tilt about the sustainer in a tilt direction omni-directionally around the central axis and at a tilt angle from the central axis; and a movement converting mechanism provided between said supporting member and said movable member to transmit force between said supporting member and said movable member, said movement converting mechanism including a slider having a cylinder and a round flange to slide upward or downward on said supporting member in an axial direction of the central axis when said movable member is tilted and to be returned when said movable member is freed, and an elastic member provided between the round flange of said slider and said supporting member to give a restoring force to said slider when said movable member is tilted and to give a load to a movement of said slider in both up and down directions at the same time along the central axis, wherein the cylinder of said slider slides with said load along the cylinder guide of said supporting member when one part of said movable member falls in the axial direction of the central axis while the other part of said movable member rises in the axial direction of the central axis if said movable member is tilted, and wherein said movement converting mechanism not only converts transversely tilting movement of the center shaft to longitudinally cylindrical sliding movement of said slider performed in the axial direction of the central axis when said movable member is tilted or freed but also applies force to said movable member so as to bring the center shaft to the central axis before said movable member is tiled and after said movable member returns to a former position on the central axis so that vibration or shocks added to the pointing device can be avoided.

2. A pointing device according to claim 1, wherein said movable member further comprises:

a round rim perpendicularly projected from the center shaft, and encircling the center shaft; and a pivot provided to the center shaft so as to be sustained by the sustainer.

3. A pointing device according to claim 2, wherein said supporting member further comprises:

a base attached to the object and spread perpendicularly from the central axis, and having said sustainer on the central axis and said cylinder guide for being used with said movement converting mechanism, standing perpendicularly on said base around the central axis; and a round housing standing on said base around the central axis, for housing said movement converting mechanism.

4. A pointing device according to claim 3, wherein said slider includes a disk spread perpendicularly from the central axis so as to contact said round rim; and wherein said elastic member includes a helical spring to apply force to the slider in the axial direction so that said disk maintains contact with said round rim.

5. A pointing device according to claim 4, wherein said movable member further comprises a pointer positioning element stored in said center shaft, for remotely giving information on the tilt direction and the tilt angle of said center shaft toward the object.

6. A pointing device according to claim 5, further comprising:

pointer co-ordinate position detectors being at least two in number, provided on the object so as to be separated at equal distance from the central axis respectively, for remotely receiving the information on tilt direction and the tilt angle of said center shaft from said pointer positioning element and producing signal of the position and the moving speed of the pointer on the display.

7. A pointing device according to claim 4, wherein said supporting member further comprises a wall for defending said movement converting mechanism from dust.

8. A pointing device according to claim 4, wherein the object is a printed circuit board, said pointer positioning element is a permanent magnet, and said pointer co-ordinate position detectors are Hall elements.

9. A pointing device according to claim 1, further comprising:

a moving mechanism provided beneath said supporting member through the object, for changing operation of the pointing device from an operation performed under an analog pointing system to an operation to be performed under a digital pointing system, by turning a part of said moving mechanism; and a switching unit provided between the object and said moving mechanism, for performing switching operation when said part of said moving mechanism is turned in accordance with the digital pointing system.

10. A pointing device according to claim 9, wherein said moving mechanism comprises:

a stator comprising a center post fixed to the object so as to be placed on the central axis and a plurality of fixed cams provided around said center post;

a rotor affixed to said center post so as to turn around said center post, comprising a plurality of rotating cams provided opposite to said fixed cams respectively, so that said rotor is raised up when said rotating cams run on said fixed cams respectively by turning said rotor in accordance with the digital pointing system; and a spring provided between the object and said rotor along a surface of said center post, for pushing said rotor toward said stator.

11. A pointing device according to claim 10, wherein said switching unit comprises a plurality of switches raised by said moving mechanism so that one of said plurality of switches is turned ON by tilting said movable member when said rotor is turned in accordance with the digital pointing system.

12. A pointing device according to claim 9, wherein said moving mechanism comprises:

a rotor comprising a center post fixed to the object so as to be placed on the central axis, a disk screwed to said center post so that said disk can be rotated around said center post, and a plurality of rotating cams provided on said disk, around said center post;

a stator affixed to said center post through a hole of said stator so as to slide on said center post, comprising a plurality of fixed cams provided opposite to said rotating cams respectively so that said stator is raised when said fixed cams run on said rotating cams respectively by turning said rotor in accordance with the digital pointing system; and a spring provided between the object and said stator along a surface of said center post, for pushing said stator toward said rotor.

13. A pointing device according to claim 12, wherein said switching unit comprises a plurality of switches raised by said moving mechanism so that one of said plurality of switches is turned ON by tilting said movable member when said rotor is turned in accordance with the digital pointing system.

14. A pointing device according to claim 13, wherein said center post of said rotor comprises a straight ditch in a direction of the central axis, and said stator comprises a projection that protrudes inward across the hole so that said projection is inserted into said straight ditch, for preventing said stator from turning together with said rotor.

15. A moving mechanism set on a surface, for moving an article, said moving mechanism comprising:

a rotor comprising a center post set on the surface, a disk screwed to said center post so as to turn around said center post, a plurality of rotating cams provided on said disk so as to be arranged around said center post, and a straight ditch running in a direction the same as a central axis of said center post; and a stator fitted to said center post through a center hole of said stator so as to slide on a surface of said center post, said stator comprising a plurality of fixed cams provided so as to be opposite said rotating cams respectively so that the article on said stator is moved toward the surface when said rotating cams run on said fixed cams respectively by turning said rotor, and a projection protruded inward towards the center hole so as to be inserted to said straight ditch, for preventing said stator from turning together with said rotor.

* * * * *

UNITED STATES PATENT AND TRADEMARK OFFICE

CERTIFICATE OF CORRECTION

PATENT NO. : 6,266,046 B1
DATED : July 24, 2001
INVENTOR(S) : Takashi Arita

It is certified that error appears in the above-identified patent and that said Letters Patent is hereby corrected as shown below:

Column 14,
Line 24, please cancel claim 9 and substitute therefor the following claim 9:

9. A pointing device for moving a pointer on a display, said pointing device comprising: a supporting member to support and mount the pointing device on an object, said supporting member including a sustainer positioned on a central axis of said supporting member;

a movable member manually actuated for moving the pointer toward a required point on the display at a required speed, said movable member including a center shaft enabling manual tilt about the sustainer in a tilt direction omni-directionally around the central axis and at a tilt angle from the central axis;

a movement converting mechanism provided between said supporting member and said movable member, said movement converting mechanism including a slider to slide in an axial direction of the central axis and an elastic member provided between said slider and said supporting member to give a load to a movement of said slider;

a moving mechanism provided beneath said supporting member through the object, for changing operation of the pointing device from an operation performed under an analog pointing system to an operation to be performed under a digital pointing system, by turning a part of said moving mechanism; and a switching unit provided between the object and said moving mechanism, for performing switching operation when said part of said moving mechanism is turned in accordance with the digital pointing system.

Signed and Sealed this

Sixteenth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,266,046 B1
DATED : July 24, 2001
INVENTOR(S) : Takashi Arita

It is certified that error appears in the above-identified patent and that said Letters Patent is hereby corrected as shown below:

Title page,
The title page, showing the illustrative figure, should be deleted and substitute therefore the attached title page.

Drawings,
Drawing sheet, consisting of figure 4,8 and 9, should be deleted to be replaced with the drawing sheets, consisting of figure 4,8 and 9, as shown on the attached page.

Column 13,
Line 43, change “tiled” to -- tilted --

Signed and Sealed this

Twenty-seventh Day of August, 2002

*Attest:*

*Attesting Officer*

JAMES E. ROGAN
*Director of the United States Patent and Trademark Office*

(12) United States Patent
Arita

(10) Patent No.: US 6,266,046 B1
(45) **Date of Patent: *Jul. 24, 2001**

(54) POINTING DEVICE FOR MOVING AND POSITIONING A POINTER ON A DISPLAY OF A COMPUTER

(75) Inventor: Takashi Arita, Tokyo (JP)

(73) Assignee: Fujitsu Takamisawa Component Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/864,963

(22) Filed: May 29, 1997

(30) Foreign Application Priority Data

May 29, 1996 (JP) ..... 8-134920

(51) Int. Cl.[7] ..... G09G 5/00
(52) U.S. Cl. ..... 345/156; 345/157; 345/161
(58) Field of Search ..... 345/156–159, 345/160, 161; 200/5 R, 6 R, 8 R

(56) References Cited

U.S. PATENT DOCUMENTS

| | | | | |
|---|---|---|---|---|
| 3,731,546 | | 5/1973 | MacDonald | 74/63 |
| 4,488,017 | * | 12/1984 | Lee | 200/5 R |
| 4,496,217 | | 1/1985 | Aoyagi | 350/255 |
| 4,748,323 | * | 5/1988 | Holiday | 250/221 |
| 4,977,298 | * | 12/1990 | Fujiyama | 200/5 |
| 5,043,709 | * | 8/1991 | Kim | 340/709 |
| 5,140,313 | * | 8/1992 | Wen | 340/709 |
| 5,252,821 | * | 10/1993 | Sugimura | 250/22 |
| 5,278,557 | * | 1/1994 | Stokes et al. | 341/34 |
| 5,473,325 | * | 12/1995 | McAlindon | 341/20 |
| 5,504,502 | | 4/1996 | Arita et al. | 345/160 |
| 5,555,004 | * | 9/1996 | Ono et al. | 345/161 |
| 5,675,359 | * | 10/1997 | Anderson | 345/161 |
| 5,706,027 | * | 1/1998 | Hilton et al. | 345/156 |
| 5,714,980 | * | 2/1998 | Niino | 345/160 |

FOREIGN PATENT DOCUMENTS

| | | |
|---|---|---|
| 41 11 140 | 11/1991 | (DE) . |
| 0 432 786 | 6/1991 | (EP) . |
| 2 145 502 | 3/1985 | (GB) . |

* cited by examiner

*Primary Examiner*—Almis R. Jankus
*Assistant Examiner*—Henry N. Tran
(74) *Attorney, Agent, or Firm*—Staas & Halsey LLP

(57) ABSTRACT

A pointing device for moving a display pointer by tilting a center shaft including a magnet and using Hall elements fixed near the magnet. The center shaft is sustained by a pivot sustainer fixed on a central axis of the device, and the tilting movement of the center shaft is changed to movement made along the central axis by a movement converting mechanism using spring force, for moving the magnet back on the central axis when the center shaft is freed from tilting.

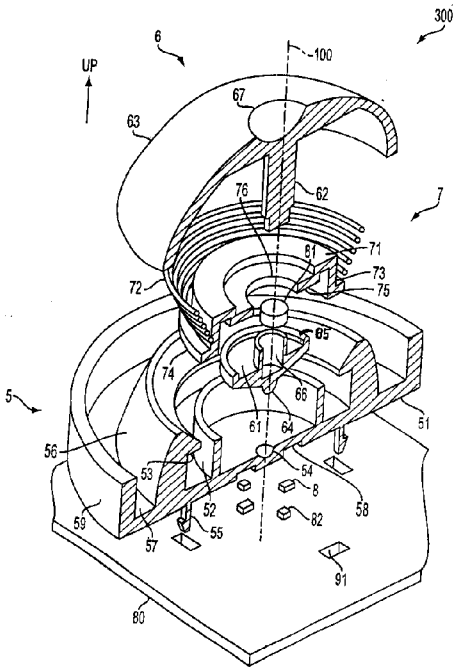

15 Claims, 10 Drawing Sheets